US007040828B2

(12) United States Patent
LaPointe

(10) Patent No.: US 7,040,828 B2
(45) Date of Patent: May 9, 2006

(54) PAINT TOUCHUP JAR

(76) Inventor: Cathy A. LaPointe, 17315 Stevens Forest Lake St., Cassopolis, MI (US) 49031

( * ) Notice: Subject to any disclaimer, the term of this patent is extended or adjusted under 35 U.S.C. 154(b) by 145 days.

(21) Appl. No.: 10/709,059

(22) Filed: Apr. 9, 2004

(65) Prior Publication Data

US 2005/0226676 A1 Oct. 13, 2005

(51) Int. Cl.
*A45D 33/00* (2006.01)
*A46B 11/00* (2006.01)

(52) U.S. Cl. ..... 401/130; 401/126

(58) Field of Classification Search ..... 401/121, 401/122, 123, 126, 48, 130
See application file for complete search history.

(56) References Cited

U.S. PATENT DOCUMENTS

| | | | | |
|---|---|---|---|---|
| 2,168,179 | A * | 8/1939 | Tobey | 401/202 |
| 2,376,046 | A * | 5/1945 | Gelfand | 239/47 |
| 3,375,538 | A * | 4/1968 | Mains et al. | 15/118 |
| 4,752,147 | A * | 6/1988 | Persi | 401/126 |
| 6,676,320 | B1 * | 1/2004 | Wainer | 401/122 |

* cited by examiner

*Primary Examiner*—David J. Walczak
(74) *Attorney, Agent, or Firm*—Richard D. Fuerle

(57) ABSTRACT

A paint touchup jar has a cylindrical container with a base, vertical sides, and a threaded rim. A threaded lid that can be screwed onto the threaded rim. A cylindrical sponge attached to the inside of said threaded lid. A double lid can also be used with the container. The double lid has two lids attached back-to-back, with a cylindrical sponge attached to the inside of only one of the lids.

20 Claims, 2 Drawing Sheets

PAINT TOUCHUP JAR

BACKGROUND OF INVENTION

This invention relates to ajar for holding a portion of the paint used to paint a room or another surface. In particular, it relates to a paint touchup jar that has a sponge mounted under the lid.

When a room is painted, there is usually leftover paint. If the paint is scratched, marked, or otherwise damaged and must be repaired, it is necessary to find a brush, locate the can of paint that was used for that particular room, and re-open the can with a screwdriver. After the damaged surface has been repaired, the can must again be sealed, the brush cleaned, and both put away. If the brush is cleaned in a sink, this can create a substantial amount of cleanup work. And, when the lid is hammered back down onto the can, paint in the rim of the can may be sent splattering around the room.

SUMMARY OF INVENTION

I have invented a paint touchup jar for holding a small portion of the paint used to paint a room or another surface. Because the jar is small, it can be placed in a closet in the room or in another convenient location where it can be easily located. The jar is provided with a label that can be written on so that the room that was painted and other information can be placed right on the jar.

A sponge is mounted on the inside of the lid of the jar. When a touchup is needed, the lid is simply unscrewed and the lid, with the sponge containing some of the paint, is used to repair the damaged surface. The lid is then screwed back. It is not necessary to pry open a can, clean the sponge, or hammer a lid back down.

DETAILED DESCRIPTION

Figure 1:
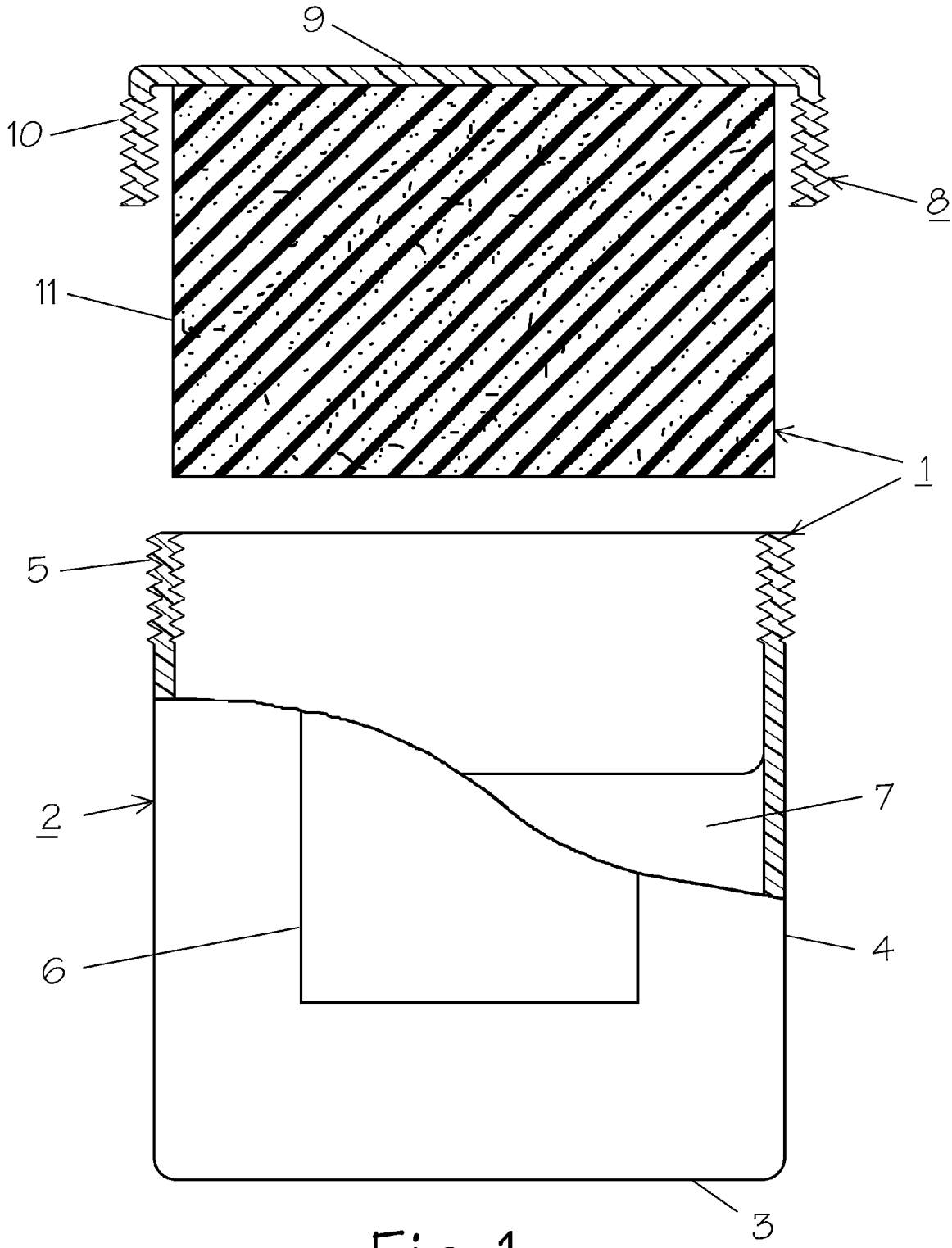
FIG. 1 is a side view partially in section of a paint touchup jar according to this invention.

In FIG. 1, paint touchup jar 1 comprises cylindrical container 2, which has a horizontal base 3 and vertical side 4. The rim 5 of container 2 is threaded. There is a label 6 on side 4 of container 2. Information, such as the room that was painted and the brand and color number of the paint, can be written on label 6. Inside container 2 is an amount of paint 7, which may be oil-based or water-based (latex).

Lid 8 has a central portion 9 and a threaded rim 10 that can be screwed onto threaded rim 5 of container 2. To the inside of central portion 9 is attached a cylindrical sponge 11. Cylindrical sponge 11 is preferably attached by adhesive, such as an epoxy, but it can also be attached by other means, such as hot glue. Like container 2, sponge 11 is circular in cross-section. It has a diameter at least as great as the inside diameter of rim 5 so that it is squeezed when placed inside container 2, which reduces dripping when it is removed and expands. Preferably, the diameter of sponge 11 is about ⅛ to about ⅝ inches greater than the inside diameter of rim 5. Sponge 11 preferably has a length of about 1 to about 2½ inches. Sponge 11 may be supported internally by a flexible or rigid post (not shown), if desired.

A brush should not be used instead of a sponge in this invention because, unlike a sponge, dirt, grease, etc. can be trapped in the bristles of a brush and a brush may leave brush marks on the touched-up paint. Brushes also age much faster than sponges and may drip when removed from the jar. Also, a single type of brush could not accommodate both oil and latex paint, as a sponge can. Finally, a brush would be difficult to attach to the lid of the jar.

Container 2 may be about 2 to about 4 inches in diameter and about 1½ to about 3 inches deep. While larger sizes may be used, they are generally not needed for touching up and smaller sizes may not hold a sufficient amount of paint to be very useful. Container 2 preferably holds about 2 to about 4 ounces of paint. Container 2 is preferably transparent, so that the color of the paint within it can be checked without opening jar 1.

Container 2 and its lid 8 may be made of a paint-resistant material that does not rust or corrode in the presence of paint and will not damage or alter the color of the paint. Preferably, container 2 and lid 8 are made of the same material. Suitable materials include plastic, glass, metals such as aluminum and stainless steel, and ceramics. The preferred material is a plastic, such as polystyrene or polypropylene, as plastic is inexpensive and will not corrode or discolor the paint.

Figure 2:
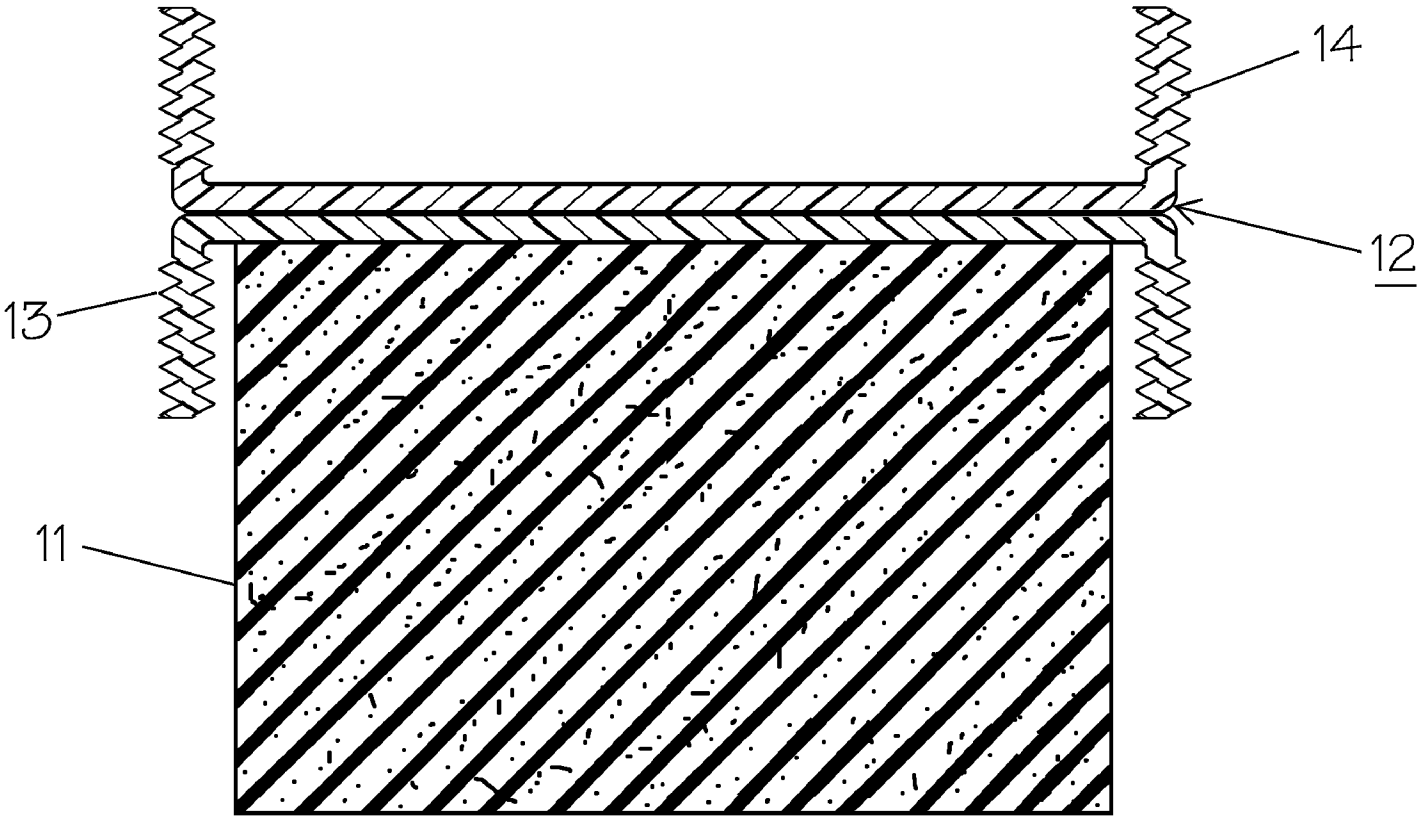
FIG. 2 is a plan view of an alternative lid that can be used with the cylindrical container shown in FIG. 1.

FIG. 2 shows an alternative lid 12 that can be used with the container 2 shown in FIG. 1. Double lid 12 has a first lid 13, which may be identical to lid 8 shown in FIG. 1 with sponge 11 attached to the inside. In addition, second lid 14, which may be identical to lid 13 but without a sponge attached, is attached back-to-back to lid 13. The central portions of the two lids are preferably attached to each other by adhesive, by they could also be attached by other means, such as by heat bonding or mechanically. The two lids may also be molded out of plastic or other materials as a single piece.

The embodiment of FIG. 1 is preferably sold as an empty jar so that the consumer can store in it any paint he wishes to. It could also be sold as part of a package with a larger quantity of paint and could be already filled with some of that paint. An empty paint touchup jar is filled with some of the paint left over after painting a room or other surface. When the surface needs to be touched up, the jar may be turned or shaken to be sure the paint contacts the sponge. The jar is opened and the sponge is applied to the surface, holding the lid. When finished, the lid is simply screwed back onto the jar. It is not necessary to wash the sponge before screwing the lid back onto the jar.

The embodiment of FIG. 2 helps to reduce air drying of the paint and can be used when it is necessary or desirable to clean the sponge after painting. For storage, paint is placed in the empty jar and the double lid is screwed on to the container with the sponge on the outside of the container. When a touchup is needed, the lid is unscrewed and the sponge is inserted into the paint and the paint is applied to the surface. When finished, the sponge may be stored inside the jar without cleaning it. Alternatively, the sponge may be cleaned and the jar capped with the sponge on the outside of the jar.

If the jar is not going to be open for a long time, it can be left open while the touchup is performed by holding the lid. But if the jar is going to be open for a significant amount of time, the lid that does not have the sponge attached to it can be screwed onto the jar and the entire jar can be held to perform the touchup. In that way, air is prevented from drying out the paint in a container that is left open. When finished, the lid can be unscrewed and inverted so that the sponge is inside the jar when the lid is screwed back on, or the sponge may be washed and left outside the jar. Also, if the sponge becomes dirty or the paint on it dries out, it can be cleaned and left on the outside of the container to dry while the other lid keeps air out of the container.

The invention claimed is:

1. A paint touchup jar comprising (A) a cylindrical container at least about 2 inches in diameter, consisting essentially of a base and a vertical side, said vertical side having a threaded rim that extends co-linearly with said vertical side;

(B) a threaded lid that can be screwed onto said threaded rim; and (C) a cylindrical sponge attached to the inside of said threaded lid, where the diameter of said sponge exceeds the inside diameter of said rim, whereby said sponge contacts said rim.

2. A paint touchup jar according to claim 1 wherein said cylindrical container and said lid are made of transparent plastic.

3. A paint touchup jar according to claim 1 wherein another lid that is identical to said threaded lid is attached back-to-back to said threaded lid.

4. A paint touchup jar according to claim 1 wherein the diameter of said sponge exceeds the inside of the diameter of said rim by about ⅛ to about ⅝ inches.

5. A paint touchup jar according to claim 1 including an amount of a water-based paint within said container.

6. A paint touchup jar according to claim 1 including an amount of an oil-based paint within said container.

7. A paint touchup jar according to claim 1 wherein said cylindrical container is about 2 to about 4 inches in diameter and about 1½ to about 3 inches deep.

8. A paint touchup jar according to claim 1 wherein said cylindrical container holds about 2 to about 4 ounces of paint.

9. A paint touchup jar according to claim 1 wherein said cylindrical sponge is about 1 to about 2½ inches in length.

10. A method of storing a small quantity of paint for touching up a painted surface comprising (A) placing a quantity of the paint used to paint said painted surface inside a paint touchup jar according to claim 1; and (B) screwing said threaded lid onto the threaded rim of said container.

11. A paint touchup jar containing paint stored therein according to the method of claim 10.

12. A method of touching up a damaged painted surface with a paint touchup jar according to claim 11 comprising (A) contacting paint within said container with said sponge;

(B) unscrewing said lid and removing said sponge from said container;

(C) applying paint on said sponge to said damaged painted surface; and (D) screwing said lid back onto said container.

13. A paint touchup jar comprising (A) a cylindrical container about 2 to about 4 inches in diameter, consisting of a base and a vertical side, said vertical side having a threaded rim that extends co-linearly with said vertical side;

(B) paint within said cylindrical container;

(C) a single threaded lid that can be screwed onto said threaded rim; and (D) a cylindrical sponge attached to the inside of said threaded lid, where the diameter of said sponge is about ⅛ to about ⅝ inches greater than the diameter of the inside of said threaded rim, whereby said sponge contacts said rim.

14. A method of touching up a damaged painted surface with a paint touchup jar according to claim 13 comprising (A) contacting paint within said container with said sponge;

(B) unscrewing said lid and removing said sponge from said container;

(C) applying paint on said sponge to said damaged painted surface; and (D) screwing said lid back onto said container.

15. A paint touchup jar comprising (A) a cylindrical container about 2 to about 4 inches in diameter, consisting of a base and a vertical side, said vertical side having a threaded rim that extends co-linearly with said vertical side;

(B) paint within said cylindrical container;

(C) a first threaded lid screwed onto said threaded rim;

(D) a second threaded lid that can be screwed onto said threaded rim, where said first threaded lid is attached to back-to-back to said second threaded lid; and (E) a cylindrical sponge attached to the inside of said second threaded lid, where the diameter of said sponge is about ⅛ to about ⅝ inches greater than the diameter of the inside of said threaded rim, whereby said sponge contacts said rim.

16. A paint touchup jar according to claim 15 wherein said cylindrical container and said lid are made of transparent plastic.

17. A paint touchup jar according to claim 15 wherein said cylindrical container is about 2 to about 4 inches in diameter and about 1½ to about 3 inches deep.

18. A paint touchup jar according to claim 15 wherein said sponge is about 1 to about 2½ inches in length.

19. A paint touchup jar according to claim 15 wherein said paint is a latex paint.

20. A method of touching up a damaged painted surface with a paint touchup jar according to claim 15 comprising (A) unscrewing said first lid (B) contacting paint within said container with said sponge;

(C) applying paint on said sponge to said damaged painted surface; and (D) inserting said sponge into said container and screwing on said second lid or cleaning said sponge and screwing on said first lid.

* * * * *